United States Patent [19]

Chu et al.

[11] 4,313,890

[45] Feb. 2, 1982

[54] POLYOL ESTER FUNCTIONAL FLUIDS

[75] Inventors: Nan S. Chu, Hartsdale; Nye A. Clinton, Brewster, both of N.Y.; Robert A. Cupper, Ridgefield, Conn.; Philip F. Wolf; Priscilla B. Stanley, both of Pleasantville, N.Y.

[73] Assignee: Union Carbide Corporation, New York, N.Y.

[21] Appl. No.: 116,618

[22] Filed: Jan. 29, 1980

Related U.S. Application Data

[63] Continuation of Ser. No. 920,832, Jun. 30, 1978, abandoned, which is a continuation-in-part of Ser. No. 782,598, Mar. 30, 1977, abandoned.

[51] Int. Cl.[3] ..... C09F 5/08

[52] U.S. Cl. ..... 260/410.6; 560/254; 560/263; 252/565

[58] Field of Search ..... 252/565; 560/263, 254; 260/410.6

[56] References Cited

U.S. PATENT DOCUMENTS

| | | | |
|---|---|---|---|
| 3,049,557 | 8/1962 | Emrick | 260/410.6 |
| 3,099,665 | 7/1963 | Emrick et al. | 260/410.6 |
| 3,282,971 | 11/1966 | Metro et al. | 260/410.6 |
| 3,341,574 | 9/1967 | Taylor et al. | 252/565 X |
| 3,441,600 | 4/1969 | Chao et al. | 252/565 X |
| 3,849,456 | 11/1974 | McMullen | 260/410.9 R |
| 4,032,550 | 6/1977 | White et al. | 260/410.6 |
| 4,038,297 | 7/1977 | Rodenberg et al. | 260/413 |
| 4,053,491 | 10/1977 | Koch et al. | 260/410.6 |
| 4,061,581 | 12/1977 | LeLeu et al. | 252/565 X |
| 4,144,183 | 3/1979 | Koch et al. | 252/565 |
| 4,178,261 | 12/1979 | Dhein et al. | 252/565 X |
| 4,212,816 | 7/1980 | Hentschel et al. | 260/410.6 |

*Primary Examiner*—Paul F. Shaver
*Attorney, Agent, or Firm*—Gary L. Wamer

[57] ABSTRACT

Synthetic polyol ester fluids useful as lubricants or hydraulic fluids have been prepared by the esterification of ethylene-methyl formate telomerization products with polyols containing from two to about six hydroxyl groups.

10 Claims, No Drawings

POLYOL ESTER FUNCTIONAL FLUIDS

This application is a continuation of our prior U.S. application Ser. No. 920,832, filing date June 30, 1978, now abandoned, which is a continuation-in-part of application Ser. No. 782,598, filing date Mar. 30, 1977, now abandoned.

BACKGROUND OF THE INVENTION

This invention pertains to synthetic polyol ester fluids and in particular to those prepared by the transesterification of ethylene-methyl formate telomerization products with polyols having two to about six free hydroxyl groups.

In the years following World War II, the acyl esters of polyhydric alcohols and alkyl esters of dicarboxylic acids were demonstrated to be high performance, synthetic engine lubricants. The former class of esters are most often prepared from a low molecular weight straight chain carboxylic acid containing 3 to 10 carbon atoms and a polyhydric alcohol (polyol) containing no hydrogens on the carbon "beta" to the hydroxyl group. Typical polyols employed are pentaerythritol, dipentaerythritol, trimethylolpropane, neopentyl glycol, and the like. The formation of these lubricant (polyol) esters is typically catalyzed by a variety of acidic compounds; derivatives of titanium (IV) being especially effective. In lieu of the carboxylic acid, its ester derivative can be substituted.

The bulk properties of the polyol ester lubricants, i.e., viscosity, volatility and low temperature flow characteristics are a reflection of molecular weight and shape, size and structure of the acyl group, number of mixed ester components, functionality of the polyol and method of preparing the mixed esters. It is required that the bulk liquid maintain its ability to lubricate various moving parts of the engine over a broad temperature range. The art teaches that various polyol esters of dicarboxylic acids (e.g., adipic acid) and those of moderate molecular weight linear monocarboxylic acids (e.g., octanoic acid) produce lubricants with the desired properties. It is also taught that $\alpha$-mono- and $\alpha$, $\alpha$-disubstituted carboxylic acids produce polyol esters which of themselves are inherently less desirable as synthetic lubricants. These acids can, nonetheless, serve as components of a mixed polyol ester which contains both linear and substituted carboxylic acid moieties. In practice, pure acids or mixtures of pure acids are admixed with a polyol or mixture thereof, generally in the presence of a catalyst, and water is removed by distillation as the lubricant ester is formed. The product is treated with water to hydrolyze and remove catalyst. The residual polyol ester is dried and used, in general, without further purification.

In general, fluids meeting the requirements for synthetic lubricants have the following properties:

(1) Wide liquidus range
(2) Range of available viscosities
(3) Low volatility
(4) Low freezing or pour point
(5) High flash point
(6) Good oxidation and thermal stability
(7) Susceptibility to additive treatment for the improvement of properties such as viscosity index, pour point, oxidation stability, metal corrosion resistance, lubrication and wear characteristics, and the ability of the fluid to maintain clean surfaces.

The synthetic polyol ester fluids of this invention are particularly suited to lubricant and hydraulic applications in engines such as gas turbine, Rankine, Sterling, rotary, spark ignition (Otton Cycle) and compression ignition (Diesel) engines of both 4-stroke and 2-stroke cycle designs. Requirements for all of these encompass many of the properties listed above. More specific requirements are outlined below in terms of low-temperature and moderate-temperature applications.

| PROPERTY | LOW TEMPERATURE | MODERATE TEMPERATURE |
|---|---|---|
| Viscosity, cSt, | | |
| at 210° F. | 1–10 | 1–50 |
| at 0° F. | 400–2400 | 2400–100,000 |
| at −40° F. | 400–15,000 | |
| at −65° F. | 2000–25,000 | |
| Pour Point, °F. | −90 to 0 | 0 to 60 |
| Flash Point, °F. | 200 to 500 | 300 to 700 |

Two primary regimes of rubbing or sliding and rolling motion lubrication are recognized; hydrodynamic and boundary. The hydrodynamic regime involves that component of lubrication that maintains a film separating the moving parts. This depends upon the functional fluid, and particularly the viscosity of the fluid. Furthermore, the viscosity-temperature and viscosity-pressure properties of the fluid play an important role in this lubrication regime. Viscosity-temperature relationships of functional fluids generally are classified according to their extended viscosity index (ASTM D-2270). Ordinarily, an extended viscosity index ($V.I._E$) of 100 or more is desirable for most hydraulic and engine lubrication requirements.

The boundary component of lubrication predominates when the fluid base fails to provide a separating layer between the moving surfaces being lubricated. Although the base fluid plays a role in boundary lubrication through the processes of surface adsorption and chemical break-down and reaction at the surfaces; i.e., the generation of surface resins, lubrication in this regime normally is dominated by additives that perform also through interfacial physical and chemical reactions. So-called anti-wear, load-carrying, and extreme pressure (EP) additives function almost exclusively by chemical reaction at the surfaces.

The use of polyol esters of alkanoic acids as synthetic lubricants is well known and these lubricants have been used commercially for many years, chiefly in aircraft gas turbine engines such as those described in the United States military specification MIL-L-23699. Basically, this specification requires a product having the following physical characteristics:

| | |
|---|---|
| Viscosity, cSt. | |
| at 210° F. | 5–5.5 |
| at 100° F. | 25 min. |
| at −40° F. | 12,000 max. |
| Pour Point, °F. | −65 max. |
| Flash Point, °F. | 475 max. |

Products meeting the MIL L-23699 requirements, as well as those of commercial gas turbine-powered aircraft are prepared from esters of polyols such as neopentyl glycol (2,2-dimethyl-1,3-propanediol), trimethylolpropane (2-ethyl-2-hydroxymethyl-1,3-propanediol), pentaerythritol(2,2-bis(hydroxymethyl)-1,3-propanediol), dipentaerythritol(bis-[2,2,2-trihydroxymethylethyl]ether) with mixtures of selected straight-chain and branched-chain acids. Similar polyol esters have been proposed and presumably are used in commercial products for automotive engine lubrication.

Acids used in prior art ester lubricants having the neopentyl structure include the common normal and branched-chain monobasic acids as for example, butyric, n-pentanoic, iso-pentanoic, n-hexanoic, various methyl-branched hexanoic acids, and analogous higher acids having up to a total of 20 carbon atoms. For most purposes, acids having more than 10 to 12 carbon atoms are excluded because of the relatively high pour points of their polyol esters. Furthermore, current art teaches the use of mixtures of acids, generally ranging from products having 5 carbons to those containing about 10 carbons. Fluids include those obtained from natural products such as coconut oil, tall oil, castor oil and tallow via fat splitting or by the ozonolysis of unsaturated acids such as oleic or linoleic acids or mixtures of such acids. Acids may also be obtained through synthetic routes which include hydrocarbon oxidation or the oxidation of aldehydes produced by the hydroformylation of alpha-olefins.

SUMMARY OF THE INVENTION

Polyol esters having superior lubricating properties to those of the prior art have been developed by (A) telomerizing ethylene with methyl formate in the presence of a free radical initiator whereby a mixture of linear methyl esters (I), linear $\alpha$-alkyl methyl esters (II), and linear $\alpha,\alpha$-dialkyl methyl esters (III) is produced represented by the general formula:

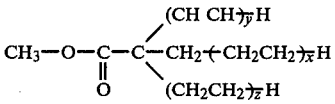

wherein x is an integer having values of 1 to about 60, y and z are each integers having values $\geqq 0$ with the proviso that the sum of $x+y+z \leqq 60$; and (B) transesterifying the mixture of esters I, II and III with at least one polyol selected from the group consisting of

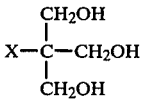

(1)

wherein X is $—CH_2OH$, alkyl having 1 to about 12 carbon atoms or aryl or aralkyl groups having 6 to about 10 carbon atoms;

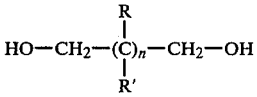

(2)

wherein n is an integer having values of 0 to 6 and each of R and R' is H or alkyl having 1 to about 12 carbon atoms; or (3) anhydro products of (1) or (2) containing 1 to about 5 ether linkages formed by the condensation of two or more $—CH_2OH$ groups with the elimination of $H_2O$ from at least one pair of $—CH_2OH$ groups, such that the resultant polyol ester consists essentially of polyol esters derived from esters (I) and (II) and untransesterified ester (II).

The ethylene-methyl formate telomerization products referred to above are a mixture of mainly methyl esters having number average molecular weights of 150 to 2000, preferably 200 to 600. These telomer mixtures are unexpectedly fortuitous since they afford polyol esters with a wide liquidus range in contrast to polyol esters of the prior art. There, blends of several polyol esters had to be made to extend their liquidus range. The free radical telomerization can be carried out at pressures of about 50 to about 800 psig and preferably at about 100 to about 600 psig at temperatures in the range of about 20° to about 150° C. The choice of free radical initiator is not narrowly critical but will determine the reaction temperature depending upon the half-life temperature of the initiators chosen. For example, diacetyl peroxide can be used effectively at near ambient temperatures while di-t-butyl peroxide requires temperatures from about 100° to 150° C. to effect telomerization. Exemplary free radical initiators include peroxy compounds such as: di-t-butyl peroxide, dicumyl peroxide, 2,5-dimethyl-2,5-di(t-butylperoxy) hexane, 2,5-dimethyl-2,5-di-(t-butylperoxy) hexyne, t-butylcumyl peroxide and the like; azo compounds such as 2,2'-azobisisobutyronitrile, $\alpha,\alpha'$-azodicyclohexane carbonitrile, axo-alpha, gamma-dimethylvaleronitrile, dimethyl-alpha, alpha'azodiisobutrate, and the like; organic acyl peroxides such as dicapryloyl peroxide, dilauroyl peroxide, dibenzoyl peroxde, acetyl cyclohexane sulfonyl peroxide, t-butyl peroxy pivalate, and the like; dialkyl peroxy dicarbonates, such as, diisopropyl peroxy dicarbonate, diisobutyl peroxy dicarbonate, di-n-butyl peroxy dicarbonate, and the like; and alkyl peralkanoates including isopropyl peracetate, t-butyl peracetate, 2-ethylhexyl peracetate, t-butyl perpropionate, n-hexyl perpropionate, 2-ethylhexyl perpropionate, t-butyl perbutyrate, isoamyl perbutyrate, t-butyl perbenzoate, and the like; as well as hydroperoxides, such as, triphenylmethyl hydroperoxide, t-butyl hydroperoxide, tetralin hydroperoxide, cumyl hydroperoxide, benzyl hydroperoxide, alpha-methyl-alpha-ethyl benzyl hydroperoxide, and the like.

The concentration of free radical initiator can vary from about 0.1 to about 5 weight percent based on the weight of the total initial telomerization reactor charge.

The polyols used in this invention include diols, such as 2,2-dimethyl-1,3-propanediol (neopentyl glycol), 2,2-diethyl-1,3-propanediol; 2-ethyl-2-methyl-1,3-propanediol; 2-butyl-2-ethyl-1,3-propanediol, and the like; triols, such as 2-ethyl-2-hydroxymethyl-1,3-propanediol, and the like; tetrols, such as, 2,2-bis(hydroxymethyl)-1,3-propanediol(pentaerythritol) and the like; hexols, such as, bis(2,2,2-trihydrocymethylethyl)ether(dipentaerythritol), mixtures of polyols and the like.

The transesterification catalysts used in this invention include Brönsted acids and bases; Lewis acids and bases; metal alkoxides, oxides, alkanoates or metal species containing elements such as lead, sodium, cadmium and the like converted to these species under reaction conditions. Examples of such compounds are:

Sodium methoxide and metal alkoxides, anions formed from metallic sodium, isopropyl titanate, p-toluenesulfonic acid, sulfuric acid, picrylsulfonic acid, phosphoric acid, lead acetate, magnesium oxide, boric acid and organic and inorganic derivatives thereof, tin acetate, zinc acetate, manganese acetate, calcium acetate, antimony acetate, cadmium acetate, antimony oxide, cobalt acetate, lead oxide and mixtures thereof.

The polyol esters prepared by the transesterification of the ethylene-methyl formate telomerization products and polyols described above may contain other materials in minor amounts. These other materials include hydrocarbons and unreacted alkyl alkanoates. These materials are stable and useful in their existing state as lubricants.

The polyol esters of this invention are lubricants. Their viscosity, low-temperature fluidity, lubricating ability, thermal and oxidation stability, and ability to operate in spark ignition engines make them ideal for this application. Specific properties of the polyol esters of this invention, such as pour point, may be improved by the addition of pour point depressant additives. In addition, these polyol esters may also be blended with other fluids such as dipolyol esters or dibasic acid esters derived from acids such as adipic, azelaic, sebacic, brassylic, dimer and trimer acids obtained from oleic and linoleic acids, esterified with higher alcohols containing 7 to about 18 carbom atoms.

The polyol esters of this invention may also be blended with synthetic hydrocarbon base fluids, such as, dialkyl benzenes and hydrogenated or nonhydrogenated oligomers of normal alpha-olefins, such as 1-hexene, 1-heptene, 1-octene, 1-nonene, 1-decene, 1-undecene, 1-dodecene and the like, as well as ordinary petroleum lubricating fractions and solvent-refined and dewaxed neutral oils or residual oils including bright stocks.

Specific properties of the polyol esters of this invention may also be improved by the use of additives for such properties as oxidation stability, resistance to corrosion and wear, viscosity index, pour point, foaming and air entrainment, dispersancy, and load-carrying ability. The ability of the polyol esters described herein to lubricate metal surfaces was demonstrated in a laboratory lubrication tester where comparisons were made with a conventional solvent-refined petroleum lubricating oil.

The invention is further described in the Examples which follow. All parts and percentages are by weight unless otherwise specified.

EXAMPLE 1

Preparation of Ethylene-Methyl Formate Telomer Esters

Into a 30-gallon autoclave which had been purged with dry nitrogen was pumped fifteen gallons (122.1 pounds) of methyl formate against a slight nitrogen pressure. For batch runs the reactor pressure was relieved and 1.26 pounds of di-t-butyl peroxide was added. The autoclave was then pressurized at about 150 psig with ethylene. The agitator was then turned on to insure saturation of the ethylene in the liquid phase and turned off while the excess pressure was vented. This purging procedure was carried out a total of three times to insure that the oxygen concentration in the autoclave was at a minimum. The autoclave was heated with ethylene being added so that the required pressure was achieved at operating temperature. Ethylene was then fed to the reactor at a rate sufficient to hold the operating pressure. The uptake of ethylene was determined by the weight change of the ethylene feed cylinders. In catalyst feed runs the addition of di-t-butyl peroxide was initiated at a predetermined rate, after the operating temperatures and pressures were achieved.

At the end of the run the autoclave was cooled to 15°–20° C. and the excess ethylene pressure vented. The methyl formate containing the telomer was filtered and distilled. Methyl formate was removed at a kettle temperature of 75° C. and one atmosphere pressure. The residue after distillation consisted of the ethylene-methyl formate telomer containing a small amount of methyl formate. The last traces of methyl formate were removed by further distillation. Vapor phase chromatographic analysis indicated the presence of a muntilcomponent mixture containing predominantly methyl esters of linear and branched fatty acids.

Data on this and other runs is contained in Table I.

In a commercial scale preparation a 6,000 gallon reactor was charged 37,250 lbs. of methyl formate. The reactor was purged with an ethylene flow and heated to 130° C. with an ethylene pressure of 450 lbs. To this system 360 lbs. of di-t-butyl peroxide was added over 53 hours. The reactor was held at 130° C. at 450 lbs. for 10 hours. The methyl formate solution was then removed from the reactor and the methyl formate removed by distillation to give 5538 lbs. of a liquid telomer.

EXAMPLE 2

Preparation of Polyol Ester-Catalyzed by Anions Generated from Sodium Metal

Preparation of the polyol esters of this invention is illustrated by a typical procedure. Trimethylolpropane (4.066 grams, 0.0303 mols) was added to a 500 ml 3-neck flask equipped with a mechanical stirrer and a distilling head. To the flask was added 30 ml of dichlorobenzene, 10 ml of toluene, 0.136 grams of sodium metal and 40 grams of telomer from Example 1 (0.0909 mols). The telomer molecular weight was determined by saponification equivalent. The flask was heated to a temperature of 150°–170° C. and the toluene and the toluene-methanol azeotrope allowed to distill out. As toluene was removed more was added such that the head temperature was 110° C. and the pot temperature was 150°–170° C. The flask was heated until no more methanol was evolved. After cooling the reaction mixture, the organic material was extracted with 10% hydrochloric acid. The organic phase was seaparated and washed twice with water. The material was dried and the sample heated to 150° C. at less than 0.1 mm pressure. The residue consisted of a polyol ester having a viscosity of 3.22 centistokes at 210° F., 14.91 centistokes at 100° F. and 441.8 centipoises at 0° F. with a viscosity index of 85. These data are presented in Table II as Run No. 1 together with data of other polyol esters prepared in a similar manner.

TABLE I

TELOMER REACTIONS IN 30-GALLON STIRRED AUTOCLAVE

| Run No. | Temp. (°C.) | Reactor Press. (psig) | Reaction Time (hrs) | Reaction Mode | Di-t-butyl Peroxide | Weight of Product |
|---|---|---|---|---|---|---|
| 1 | 115 | 450 | 26 | batch | 1.26 | 16.27 |
| 2 | 130 | 450 | 21 | batch | 1.26 | 12.41 |
| 3 | 130 | 450 | 31 | catalyst feed[a] | 1.13 | 17.71 |
| 4 | 130 | 450 | 59 | catalyst feed[b] | 1.10 | 17.68 |

TABLE I-continued

TELOMER REACTIONS IN 30-GALLON STIRRED AUTOCLAVE

| Run No. | Temp. (°C.) | Reactor Press. (psig) | Reaction Time (hrs) | Reaction Mode | Di-t-butyl Peroxide | Weight of Product |
|---|---|---|---|---|---|---|
| 5 | 115 | 450 | 48 | batch | 1.26 | 16.75 |
| 6 | 115 | 550 | 54 | batch | 1.26 | 31.56 |
| 7 | 122 | 450 | 36 | batch | 1.26 | 20.01 |

[a]The reacton mixture, less catalyst, at 130° C. was rapidly charged with 0.47 lb. of di-t-butylperoxide and the remaining initiator added evenly over a 13 hour period. After all the catalyst was added the reaction mixture was heated at 130° C., 18 additional hours.

[b]The reaction mixture, less catalyst, at 130° C. was fed di-t-butylperoxide evenly over a 44-hour period and then heated at 130° C. to a total of 59 hours.,

TABLE II

POLYOL ESTER LUBRICANTS FROM ETHYLENE-METHYL FORMATE TELOMER ESTERS

| RUN NO. | TRANS-ESTER-IFICA-TION CATALYST | Polyol | EMF Telomer Saponification Equivalent | Polyol Ester Properties Viscosity 210° F. eSt | Viscosity 100° F. eSt | Viscosity Index E |
|---|---|---|---|---|---|---|
| 1 | Sodium methoxide | TMP[a] | 283 | 3.22 | 14.91 | 85 |
| 2 | " | DPE[b] | 283 | 3.16 | 14.17 | 92 |
| 3 | " | PE[c] | 283 | 3.37 | 15.56 | 96 |
| 4 | " | TMP | 405 | 4.33 | 23.03 | 101 |
| 5 | " | PE | 405 | 4.03 | 20.91 | 99 |
| 6 | " | DPE | 405 | 6.49 | 55.86 | 63 |
| 7 | " | TMP | 319 | 3.56 | 17.81 | 82 |
| 8 | " | TMP | 412 | 6.16 | 37.98 | 120 |
| 9 | " | PE | 412 | 6.64 | 41.76 | 123 |
| 10 | " | DPE | 412 | 9.43 | 68.35 | 127 |
| 11 | " | NPG[d] | 429 | 4.02 | 19.47 | 115 |
| 12 | " | TMP | 429 | 6.60 | 40.04 | 129 |
| 13 | " | PE | 429 | 7.30 | 47.27 | 127 |
| 14 | " | DPE | 429 | 10.50 | 91.96 | 106 |
| 15 | " | TMP | 440 | 6.43 | 43.33 | 105 |
| 16 | " | PE | 440 | 5.87 | 36.65 | 113 |
| 17 | " | DPE | 440 | 6.65 | 44.41 | 112 |
| 18 | Metallic sodium | TMP | 490 | 5.31 | 30.56 | 116 |
| 19 | " | DPE | 490 | 5.15 | 28.20 | 124 |
| 20 | Isopropyl titanate | TMP | 505 | 6.25 | 35.63 | 137 |
| 21 | " | TMP | 505 | 6.95 | 45.73 | 120 |
| 22 | " | TMP | 490 | 5.35 | 30.17 | 123 |
| 23 | " | TMP | 505 | 6.74 | 38.91 | 142 |
| 24 | " | TMP | 501 | 5.53 | 37.19 | 130 |
| 25 | " | TMP | 505 | 7.13 | 46.42 | 124 |
| 26 | " | TMP | 552 | 5.64 | 32.16 | 127 |
| 27 | " | TMP | 433 | 6.06 | 34.06 | 137 |
| 28 | " | TMP | 413 | 5.89 | 31.65 | 145 |
| 29 | " | TMP | 413 | 6.95 | 41.57 | 139 |
| 30 | " | TMP | 495 | 5.37 | 29.22 | 131 |
| 31 | " | TMP | 797 | 10.67 | 74.83 | 141 |
| 32 | " | TMP | 552 | 6.95 | 45.01 | 123 |
| 33 | " | TMP | 552 | 5.33 | 28.95 | 130 |

[a]TMP = trimethylolpropane;
[b]PE = pentaerythritol;
[c]DPE = dipentaerythritol; and
[d]NPG = neopentyl glycol Table III contains viscosity and pour point data of polyol esters made with metallic sodium catalyst and demonstrates their susceptibility to improvement by pour point depressants and their cold cranking viscosities.

EXAMPLE 3

Preparation of Polyol Ester-Catalyzed by Titanium Isopropoxide

A typical transesterification was carried out as shown below. Into a 500 ml 4-neck round bottom flask, fitted with a mechanical stirrer, an addition funnel, a fractionation column and distilling head, a thermometer and argon gas-inlet-outlet tubes, was added 200 grams of the ethylene-formate telomer prepared in Example 1 and the desired amount of trimethylolpropane, in a mole ratio of reactive telomer/trimethylolpropane=3/1.

TABLE III

PROPERTIES OF POLYOL LUBRICANT ESTERS

| RUN NO. | TRANS-ESTERIFI-CATION CATALYST | POLYOL | KINEMATIC VISC., cSt. 210° F. | KINEMATIC VISC., cSt. 100° F. | V.I.E. | COLD-CRANKING VISCOSITY[a] 0° F., cPs. | POUR POINTS[b] Base Fluid °F. | POUR POINTS[b] Base Fluid °F. + P.P.D.[c] |
|---|---|---|---|---|---|---|---|---|
| 34 | Metallic sodium | Trimethylol-propane | 5.29 | 31.75 | 108 | 1500 | +20 | — |
| 35 | " | Trimethylol-propane | 5.74 | 37.34 | 103 | 2050 | +20 | −30 |
| 36 | " | Pentaery-thritol | 5.58 | 34.71 | 108 | 1750 | +25 | — |
| 37 | " | Dipentaery-thritol | 4.92 | 27.78 | 111 | 1080 | +10 | −25 |

[a]ASTM D-2602-72
[b]Pour Points determined by ASTM method D97-66 (reapproved 1971).
[c]0.1% by wt. of Acryloid 150 (polyacrylate methacrylate) pour point depressant Titanium isopropoxide ($7.50\times10^{-3}$ mols) was added and the mixture was again heated rapidly to 275° C. and maintained at this temperature throughout the reaction. When methanol evolution abated, heating was stopped, distilled water was added and the aqueous layer was removed from the upper oil layer. The organic layer was washed with distilled water. After drying, low boiling components were removed. The residue consisted of a polyol ester having a viscosity of 5.33 centistokes at 210° F., 28.95 centistokes at 100° F. and 1170 centipoises at 0° F., and a viscosity index of 130.

Other polyol esters made from various ethylene-methyl formate telomers and polyols exhibited the properties shown in Table II.

EXAMPLE 4

A typical transesterification catalyzed by $8.0\times10^{-3}$ M lead acetate was carried out in a manner similar to that described in Example 3. The reaction run until it reached completion, as evidenced by no further evolution of methanol. The reaction solution was washed with distilled water, dried and then low boiling components were removed.

EXAMPLE 5

Transesterification was effected following the method of Example 4 replacing lead acetate with lead oxide. The reaction was complete after two hours at 265° C.

EXAMPLE 6

Transesterification was effected following the method of Example 4 replacing lead acetate with $4.8\times10^{-3}$ gram atoms of metallic lead. Evidence of transesterification was confirmed by nmr analysis.

EXAMPLE 7

Transesterification was effected following the method of Example 4 replacing lead acetate with paratoluenesulfonic acid, 1.0 percent by weight of ester. The reaction was complete in 6 hours at 190° C.

EXAMPLE 8

Transesterification was effected following the method of Example 4 replacing lead acetate with sulfuric acid, 1.0 percent by weight of ester. The reaction was complete in 6 hours at 190° C.

EXAMPLE 9

Transesterification was effected following the method of Example 4 replacing lead acetate with picrylsulfonic acid, 1.0 percent by weight of ester. The reaction was complete in 2 hours at 190° C.

EXAMPLE 10

Transesterification was effected following the method of Example 4 replacing lead acetate with phosphoric acid, 1.0 percent by weight of ester. The reaction was complete in 13 hours at 190° C.

EXAMPLE 11

Transesterification was effected following the method of Example 4 replacing lead acetate with magnesium oxide. The reaction was complete in 3 hours at 280° C.

EXAMPLE 12

Transesterification was effected following the method of Example 4 replacing lead acetate with tin acetate. The reaction was complete in six hours at 285° C.

EXAMPLE 13

Transesterification was effected following the method of Example 4 replacing lead acetate with zinc acetate. The reaction was run at 263° C. for 7 hours. Evidence of transesterification was confirmed by nmr analysis.

EXAMPLE 14

Transesterification was effected following the method of Example 4 replacing lead acetate with manganese acetate. The reaction was run at 280° C. for 7 hours. Evidence of transesterification was confirmed by nmr analysis.

EXAMPLE 15

Transesterification was effected following the method of Example 4 replacing lead acetate with calcium acetate. The reaction was complete in 2 hours at 280° C.

EXAMPLE 16

Transesterification was effected following the method of Example 4 replacing lead acetate with antimony acetate. The reaction was complete in 7 hours at 285° C.

EXAMPLE 17

Transesterification was effected following the method of Example 4 replacing lead acetate with cadmium acetate. The reaction was complete in three hours at 280° C.

EXAMPLE 18

Transesterification was effected following the method of Example 4 replacing lead acetate with antimony oxide. The reaction was complete in 12 hours at 278° C.

EXAMPLE 19

Transesterification was effected following the method of Example 4 replacing lead acetate with cobalt acetate. The reaction was run for 3 hours at 280° C. Evidence of transesterification was confirmed by nmr analysis.

EXAMPLE 20

Lubricant Friction and Wear Tester Evaluation of Polyol Esters

The polyol esters identified in Table 1 as Runs Nos. 8 and 9 were evaluated as lubricants in a Lubricant Friction and Wear Tester at 150° C. and 80 RPM for 45 minutes together with a commercially available lubricant CITGO 90104 200N (believed to be a solvent refined 200 neutral petroleum fraction). The Lubricant Friction and Wear Tester manufactured by Faville-DeVally Corp., Bellwood, Ill. was used for this test.

TABLE IV

LUBRICANT FRICTION AND WEAR TEST

| LUBRICANT | LOAD (LBS) | SCAR WIDTH (INCHES) | LOAD BEARING STRESS ON FILM (PSI) | FRICTIONAL FORCE (LBS) | COEFFICIENT OF FRICTION |
|---|---|---|---|---|---|
| Run No. 8, Table 1 | 300 | 0.105 | 11,400 | 31 | 0.10 |
| Run No. 9, Table 1 | 450 | 0.105 | 17,100 | 54 | 0.12 |
| CITGO 90104-200N | 300 | 0.100 | 12,000 | 34 | 0.11 |

This test equipment measures the amount of wear caused by a rotating metal cylinder turning against a stationary steel block. Test data for two different polyol esters prepared herein were compared with a petroleum fraction solvent-refined neutral oil of about the same viscosity. In this test the load-bearing stress which is calculated from the measured block scar width diameter is probably the most significant information obtained. It is a measure of the load which the metal bearing parts can support without additional metal wear. The data obtained and presented in Table IV indicate that the ester from Run No. 8 behaves equivalently to the Control A. The Run No. 9 ester is superior to Control A as deduced from the observation that Control A did not permit the loading of the test machine to this level. Run No. 9 ester exhibited a very high load-bearing stress (17,000 psig).

EXAMPLE 21

Thermal Stability Of Polyol Ester

The thermal stability of the polyol ester described in Run 20, Table 1 (a trimethylolpropane ester of an ethylene-methyl formate telomer) was compared with Citgo Neutral Oil. On the basis of the observed viscosity changes and maximum pressures observed during these tests, it is concluded that the synthetic polyol ester has a superior thermal stability. The test data are presented in Table V.

TABLE V

POLYOL ESTER LUBRICANT THERMAL STABILITY TESTS

| Sample | Formulation | | Viscosities, centiStokes Before 210° F. | After 210° F. | Before 100° F. | After 100° F. | Before VI | After VI | 210° F. % Viscosity Change | Max. Pressure, psig |
|---|---|---|---|---|---|---|---|---|---|---|
| | wt. % | | | | | | | | | |
| Polyol Ester[a] | 83.60 2783-96 | | 13.15 | 6.84 | 87.73 | 41.44 | 161 | 133 | −47.98 | 100 |
| 2783-96 | 6.30 | - D.I.[1] | | | | | | | | |
| from trimethylol- | 10.01 TLA-347A | - V.I.I.[2] | | | | | | | | |
| propane | .10 A-150 | - P.P.D.[3] | | | | | | | | |
| Citgo Neutral Oil | 82.45 60/40 200N/100N (%) | | 12.99 | 5.61 | 94.15 | 35.91 | 146 | 103 | −56.81 | 270 |
| | 6.30 | - D.I. | | | | | | | | |
| | 11.15 TLA-347A | - V.I.I. | | | | | | | | |
| | .10 A-150 | - P.P.D. | | | | | | | | |

[1]D.I. = Detergent-inhibitor package
[2]V.I.I. = Viscosity index improver
[3]P.P.D. = Pour point depressant
[a]From Table 1, Run 20

EXAMPLE 22

Automotive Engine Tests

In order to evaluation the lubricant polyol esters of this invention to lubricate a spark ignition engine satisfactorily, the polyol ester identified as Run 20 in Table 1 was used to formulate an SAE 10W-40 lubricant. This lubricant comprised 84.12 wt. % of the polyol ester, 6.3 wt. % of detergent-inhibitor package, 9.48 wt. % of a viscosity index improver (Texaco TLA-347 A, an ethylene-propylene copolymer), and 0.1 wt. % of a pour point depressant Rohm and Haas, Acryloid 150 (a copolymer of mixed alkyl methacrylates wherein the alkyl groups contain from 12 to 18 carbon atoms).

Two SAE 10W-40 Controls were also used for comparison. The first (A) comprised 82.1 wt. % Citgo Neutral Oil (described in footnote (b) of Table VI, 6.3 wt. % of detergent-inhibitor package, 11.5 wt. % of the Texaco TLA-347 A viscosity index improver, and 0.1 wt. % of Rohm and Haas Acryloid 150.

Control B was a commercially available SAE 10W-40 lubricant (sold by Texaco Inc.).

The detergent-inhibitor package used in the Example and Control A contained zinc dialkyldithiophosphate, a succinimide ashless dispersant, a calcium overbased sulfonate, detergent-rust inhibitor and a dimethyl silicone anti-foam. The analysis of this detergent-inhibitor package showed the following:

| | |
|---|---|
| Specific gravity, 15.5° C. | 1.018 |
| Calcium, wt. % | 3.82 |
| Phosphorus, wt. % | 1.47 |
| Zinc, wt. % | 1.77 |
| Sulfur, wt. % | 4.68 |
| Nitrogen, wt. % | 0.33 |
| Sulfated ash, wt. % | 15.8 |

The test conditions, delineated in Table VI were used in a Coordinating Lubricant Research single-cylinder test engine. These conditions imposed a hot-cold cyclic routine. The engine test hours required for noticeable formation of sludge was used as the criterion for lubricant effectiveness in this test. Sludge deposition was quantified using standard techniques out of which a total sludge demerit rating was developed. The demerit rating for noticeable sludge formation was approximately 38 on a scale where a total sludge rating of 50 represents a perfectly clean engine. The polyol ester lubricant, Example 8, operated for 180 hours before a 37.9 sludge rating was obtained. In comparison Control A showed a rating of 33 in less than 110 hours and Control B showed a rating of 37.1 in 130 hours.

Although the invention has been described in its preferred forms with a certain degree of particularity, it is understood that the present disclosure of the preferred forms has been made only by way of example and that numerous changes may be resorted to without departing from the spirit and scope of the invention.

TABLE VI

| LOW TEMPERATURE SLUDGING TEST PROCEDURE | |
|---|---|
| Run Duration, hours* | 110 |
| Temperature Cycle, hours | 6 cold - 2 hot |
| Speed, rpm | 1500 |
| Fuel Flow, lb/hr | 3.5 |
| Air-Fuel Ratio | 14.2 |
| Mixture Temperature, °C. | 37 |
| Crankcase Pressure, psig | 0 |
| Compression Ring Gap, inches | 0.060 |
| Crankcase Blow-By, cfh | 32 |
| Spark Advance, BTC (Before Top Dead Center) | 15 |
| Oil Pressure, psig cold cycle | 40 |
| Oil Charge, lb** | 1.8 |
| Cold Cycle | |
| Coolant Jacket-Out, °C. | 43.5 |
| Oil Gallery, °C. | 46 |
| Rocker Arm Atmosphere, °C. | 35 |
| Hot Cycle | |
| Coolant Jacket-Out, °C. | 88 |
| Oil Gallery, °C. | 77 |
| Rocker Arm Atmosphere, °C. | 79 |

*If little or no sludge formation is noted, test may be extended to 174 hours.
**No oil additions allowed during the test.

U.S. Pat. Nos. 3,049,557 and 3,099,665 describe the telomerization of ethylene with both mono-α-substituted carboxylic esters of β-neopolyalcohols and with alkylene glycol diformates. Although a portion of the telomerization products from these materials do form useful lubricants this approach suffers from the problem that only a small amount of the original ester is substituted with the taxogen moieties. This leaves a crude product from which a relatively nonvolatile starting material must be removed utilizing high capital investment vacuum equipment and substantial quantities of energy. Possibly more important than this is the fact that the products of this reaction will typically contain only one telomer chain per starting molecule, thus leaving at least one unsubstituted group from the original ester molecule. The presence of substantial quantities of this functionality will produce products which inherently will be unstable towards oxidative and other free-radical type degradations. In addition to this the wax formed during the preparation of the telomer esters is difficult to remove from the crude reaction mixture and requires the addition of substantial quantities of solvents to facilitate the complete precipitation to effect removal of this unwanted material which is deleterious to lubricant performance. Contrary to this, the subject reaction of this invention, that is the telomerization of ethylene with methyl formate takes place in a volatile solvent which can readily be stripped at low temperatures and atmospheric pressure. In addition, prior to the removal of the solvent, methyl formate, precipitation of the undesirable wax formed in this reaction can be facilitated in the methyl formate itself with no additional solvents necessary. After removal of the wax and the solvent the rest of the product is, in fact, ready for transesterification with the desired polyol. The resultant polyol lubricant ester is now highly substituted and the total product mixture contains no unreacted formate bonds as would be the case in following the teachings of U.S. Pat. No. 3,099,665, nor does it contain substantial quantities of short alkyl chain dialkylacetate linkages as results in the method disclosed in the case U.S. Pat. No. 3,049,557.

Although the invention has been described in its preferred forms a certain degree of particularity, it is understood that the present disclosure has been made only by way of Example and that numerous changes may be resorted to without departing from the spirit and scope of the invention.

What is claimed is:

1. A process for the preparation of a highly substituted polyol ester containing essentially no unreacted formate bonds wherein said process comprises:

(a) reacting ethylene with methyl formate in the presence of a free radical initiator to produce a mixture of linear methyl esters (I), linear α-alkyl methyl esters (II) and linear α,α-dialkyl methyl esters (III) wherein (I) and (II) and (III) are represented by the general formula:

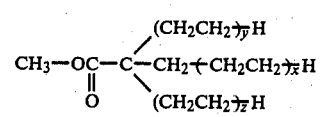

wherein X is an integer having values of 1 to about 60; y and z are each integers having values ≧0 with the proviso that the sum $(x+y+z) \leqq 60$;

(b) transesterifying the mixture of esters I, II and III with at least one polyol selected from the group consisting of:

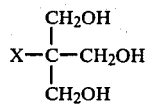

(1)

wherein X is —$CH_2OH$, alkyl having 1 to about 12 carbon atoms or aryl or aralkyl groups having 6 to about 10 carbon atoms;

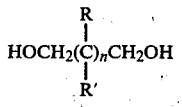

(2)

wherein n is an integer having values of 0 to 6 and each of R and R′ is H or alkyl having 1 to about 12 carbon atoms; or (3) anhydro products of (1) or (2) containing 1 to about 5 ether linkages formed by the condensation of two or more —$CH_2OH$ groups with the elimination of $H_2O$ from at least one pair of —$CH_2OH$ groups, such that the resultant polyol ester consists essentially of polyol esters derived from esters (I) and (II) and untransesterified ester (III);

(c) removing excess ethylene and methyl formate from the mixture of step (b);

(d) collecting a highly substituted polyol ester wherein said polyol ester is essentially free of unreacted formate bonds.

2. The process of claim 1 wherein the telomerization products in step (d) have a number average molecular weight of about 115 to about 1000.

3. Process claimed in claim 1 wherein the polyol is trimethylolpropane.

4. Process claimed in claim 1 wherein the polyol is pentaerythritol.

5. Process claimed in claim 1 wherein the polyol is dipentaerythritol.

6. Process claimed in claim 1 wherein the transesterification catalyst is sodium metal.

7. Process claimed in claim 1 wherein the transesterification catalyst is sodium methoxide.

8. Process claimed in claim 1 wherein the transesterification catalyst is an alkyl titanate.

9. Process claimed in claim 1 wherein the transesterification catalyst is lead or a lead derivative.

10. Process claimed in claim 1 wherein the transesterification catalyst is a heavy metal acetate.

* * * * *